US005375845A

United States Patent [19]

Cooter et al.

[11] Patent Number: 5,375,845

[45] Date of Patent: Dec. 27, 1994

[54] BRIDGE-TYPE CARD GAME WITH VARIABLE TRUMP SUIT AND DIE

[76] Inventors: Keith J. Cooter; Laura D. Cooter, both of 8652 Welbeck Way, Gaithersburg, Md. 20879

[21] Appl. No.: 114,939

[22] Filed: Sep. 2, 1993

[51] Int. Cl.[5] ..... A63F 1/00

[52] U.S. Cl. ..... 273/292; 273/146

[58] Field of Search ..... 273/146, 148 R, 274, 273/292

[56] References Cited

U.S. PATENT DOCUMENTS

| | | | |
|---|---|---|---|
| 806,662 | 12/1905 | Hammond | 273/148 R |
| 1,314,897 | 9/1919 | Paul | 273/148 R |
| 1,613,975 | 1/1927 | Bartlett et al. | 273/148 R |

OTHER PUBLICATIONS

Scarne, J., "Scarne's Encyclopedia of Games", (New York: Harper & Row), 1973.

Gibson, W. B., "Hoyle's Modern Encyclopedia of Card Games", (New York: Doubleday & Company), 1974.

Gibson, W. B., "Hoyle's Simplified Guide to the Popular Card Games", (New York: Doubleday & Company), 1963.

*Primary Examiner*—Vincent Millin

*Assistant Examiner*—William M. Pierce

*Attorney, Agent, or Firm*—Hugh E. Smith

[57] ABSTRACT

A card game and a method of playing same which is akin to bridge in the sense of following suit and the use of trump cards but entirely different in the rules and procedures. Suitable for two to four players, a regular deck of 52 cards is utilized. Initially each player is dealt fifteen cards (except with four players, each is dealt thirteen cards). Each succeeding hand is played with one less card than the previous hand being dealt to each player. Until the number of hands reaches the point where seven cards are being dealt. The trump suit (including no trump) is determined by a preset designation for each hand which appears on the game sheet and score card. At the seven card level a series of four hands are played wherein the trump suit is determined by the roll of a special die and the play governed by special rules as outlined hereinafter. Thereafter the regular procedure of decreasing by one each hand the number of cards dealt is followed until the last hand where each layer receives only one card each. Special bids are used for each hand as described herein and points awarded for making the specific bid in terms of numbers of tricks taken as well as points for each trick taken. The player with the highest score at the end is the winner.

1 Claim, 3 Drawing Sheets

FIG. 1

| 11 # OF CARDS–TRUMP | 10 PLAYER 1 _____ CALLED | GOT | SCORE | 12 PLAYER 2 _____ CALLED | GOT | SCORE | 13 PLAYER 3 _____ CALLED | GOT | SCORE | PLAYER 4 _____ CALLED | GOT | SCORE |
|---|---|---|---|---|---|---|---|---|---|---|---|---|
| 15 HEARTS | | | | | | | | | | | | |
| 14 CLUBS | 14 | 15 | 16 | 14 | 15 | 16 | 14 | 15 | 16 | 14 | 15 | 16 |
| 13 DIAMONDS | | | | | | | | | | | | |
| 12 SPADES | | | | | | | | | | | | |
| 11 NO TRUMP | | | | | | | | | | | | |
| 10 HEARTS | | | | | | | | | | | | |
| 9 CLUBS | | | | | | | | | | | | |
| 8 DIAMONDS | | | | | | | | | | | | |
| 7 SPADES | | | | | | | | | | | | |
| 7 BLIND | | | | | | | | | | | | |
| 7 HALF BLIND | | | | | | | | | | | | |
| 7 MISS | | | | | | | | | | | | |
| 7 OFF THE TOP | | | | | | | | | | | | |
| 6 NO TRUMP | | | | | | | | | | | | |
| 5 HEARTS | | | | | | | | | | | | |
| 4 CLUBS | | | | | | | | | | | | |
| 3 DIAMONDS | | | | | | | | | | | | |
| 2 SPADES | | | | | | | | | | | | |
| 1 NO TRUMP | | | | | | | | | | | | |

FINAL SCORES _____ _____ _____ _____

BRIDGE-TYPE CARD GAME WITH VARIABLE TRUMP SUIT AND DIE

BACKGROUND OF THE INVENTION

1. Field of the Invention

The present invention relates to card game and more particularly pertains to a card game which may be played by two to four players and wherein both luck and skill are involved.

2. Description of the Prior Art

The use of a wide variety of card games is known in the prior art. More specifically, card games heretofore devised and utilized for the purpose of playing by two to four players do not progressively become riskier and leave more to chance as the game progresses. Notwithstanding the myriad of card games encompassed by the crowded prior art which have been developed for the fulfillment of countless objectives and requirements, the game of the present invention and method for playing the same is unique. Typical prior art card games as shown in U.S. Pat. Nos: 4,651,997; 5,076,588; 4,807,885; 4,927,147; and 4,480,840.

In the areas of increasing skill and risk as the game proceeds, the card game according to the present invention substantially departs from the conventional concepts and designs of the prior art, and in so doing provides a card game primarily developed for the purpose of utilizing both skill and a risk-taking sense.

Therefore, it can be appreciated that there exists a continuing need for new and improved card game which can be highly entertaining and challenging- In this regard, the present invention substantially fulfills this need.

SUMMARY OF THE INVENTION

In view of the foregoing disadvantages inherent in the known types of card games now present in the prior art, the present invention provides an improved card game design and method wherein the gambling sense and card playing skill can be utilized. As such, the general purpose of the present invention, which will be described subsequently in greater detail, is to provide a new and improved card game and method for playing the same which has all the advantages of the prior art card games and none of the disadvantages.

To attain this, the present invention essentially comprises a card game and a method of playing same which is akin to bridge in the sense of following suit and the use of trump cards but entirely different in the rules and procedures. Suitable for two to four players, a regular deck of 52 cards is utilized. Initially each player is dealt fifteen cards (except with four players, each is dealt thirteen cards). Each succeeding hand is played with one less card than the previous hand being dealt to each player. Until the number of hands reaches the point where seven cards are being dealt. The trump suit (including no trump) is determined by a preset designation for each hand which appears on the game sheet and score card. At the seven card level a series of four hands are played wherein the trump suit is determined by the roll of a special die and the play governed by special rules as outlined hereinafter. Thereafter the regular procedure of decreasing by one each hand the number of cards dealt is followed until the last hand where each layer receives only one card each. Special bids are used for each hand as described herein and points awarded for making the specific bid in terms of numbers of tricks taken as well as points for each trick taken. The player with the highest score at the end is the winner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved card game which has many of the advantages of the prior art games and presents new challenges.

It is another object of the present invention to provide a new and improved card games which may be easily and efficiently manufactured and marketed.

An even further object of the present invention is to provide a new and improved card game which is susceptible of a low cost of manufacture with regard to both materials and labor, and which accordingly is then susceptible of low prices of sale to the consuming public, thereby making such card game economically available to the buying public.

Still another object of the present invention is to provide a new and improved highly entertaining card game.

Yet another object of the present invention is to provide a new and improved card game in which the ability to gamble enter into the winning thereof.

Even still another object of the present invention is to provide a new and improved card game in which substantial variety in the bidding and play thereof exists.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention, which we have names "SHYROPPO" will be better understood and objects other than those set forth above will become apparent when consideration is given to the following detailed description thereof. Such description makes reference to the annexed drawings wherein:

FIG. 1 shows the game instruction sheet and score card for the present invention.

DESCRIPTION OF THE PREFERRED EMBODIMENT

Figure 2:
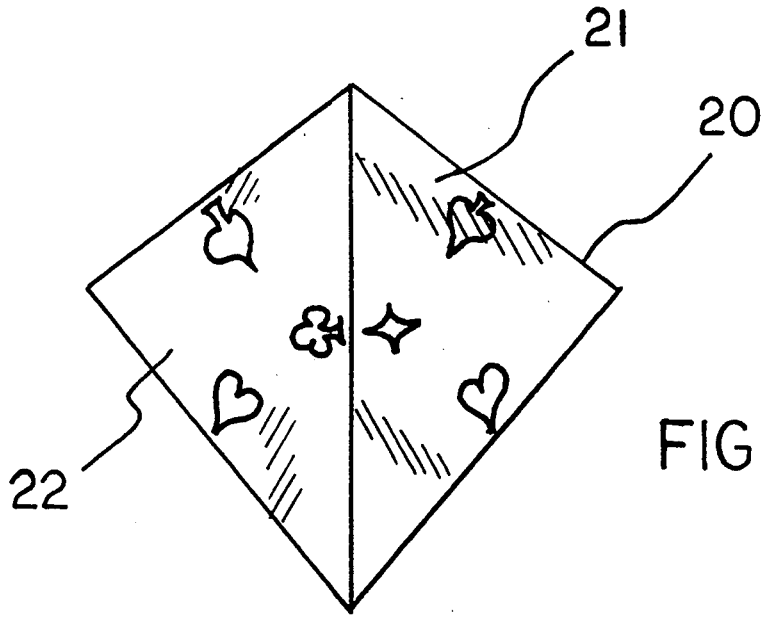
FIG. 2 is a perspective view of a special die for use in the game of the present invention.

With reference now to the drawings, and in particular to FIG. 1 thereof, a new and improved card game embodying the principles and concepts of the present invention and generally designated by the reference numeral 10 will be described.

The instruction and score sheet shown as 10 in FIG. 1 contains information to keep the players (two to four) aware of which hand is being played and to inform them, except for four special hands described below, as to which suit is trump for the specific hand.

The game is played with a standard fifty-two card deck of playing cards. To commence the game, fifteen cards are dealt out (for a two or three player game)and thirteen cards if there are four players, as indicated at 30 and 32 in FIG. 4. The first column 11 on the score sheet 10 indicates the number of cards dealt to be dealt for each hand and it will be noted that such number decreases by one for each successive hand down to 7 cards, as indicated at 36 and 38 in FIG. 4. The next four hands will be described hereinafter since the rules relating thereto are different than for the aforementioned hands. For the hands down to the first where only seven cards are dealt, the trump suit is specified as indicated in column 12.

Figure 4:
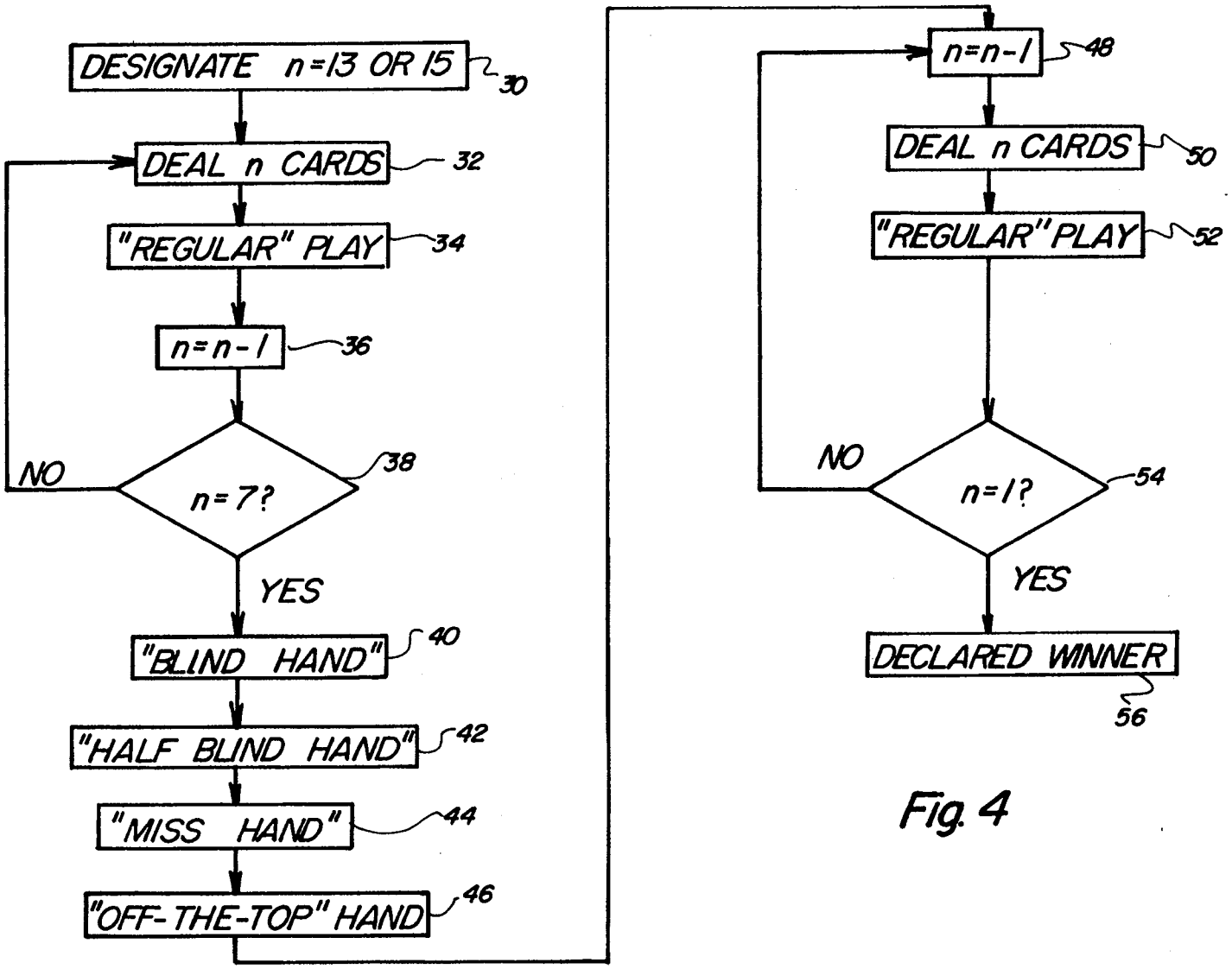
FIG. 4 is a flow chart of the preferred method of play.

As indicated at 34 in FIG. 4 and often the deal, the initial dealer being usually selected by a cut of the highest card and thereafter the deal progressing clockwise for each succeeding hand, each player must look at his or her hand of cards and, knowing which suit is trump as designated in column 11, estimates how many tricks he or she can take with such hand. The player to the left of the dealer makes the first estimate which is announced and the number written down in the "called" column 14 under the heading of Player 1. A set 13 of three scoring columns 14, 15 and 16 is provided under each players designation/name. No player can estimate a number which when added to the preceding estimates exactly equals the number of cards dealt in the particular hand, e.g. if the hand dealt in a three player game contains 15 cards each, and the first two players estimate five each, the last player (dealer) can estimate any number except five. This increases the chance that the last player to estimate may fail to exactly meet his or her estimate. When the hand is completed, each player is scored with the number of tricks taken by such player. This number is entered into the "GOT" column 15 for each player. In scoring the hand, each player receives one point for each trick taken and, in the event of taking the exact number of tricks estimated, a bonus of ten points. Whichever player is scorekeeper keeps a running total of points for each player in their respective column 16 "SCORE".

Actual play of the hand is similar to that of bridge in that one must follow suit of possible, high card takes the hand, and trumps may be used to take a trick if a player is void in the suit played.

Figure 3:
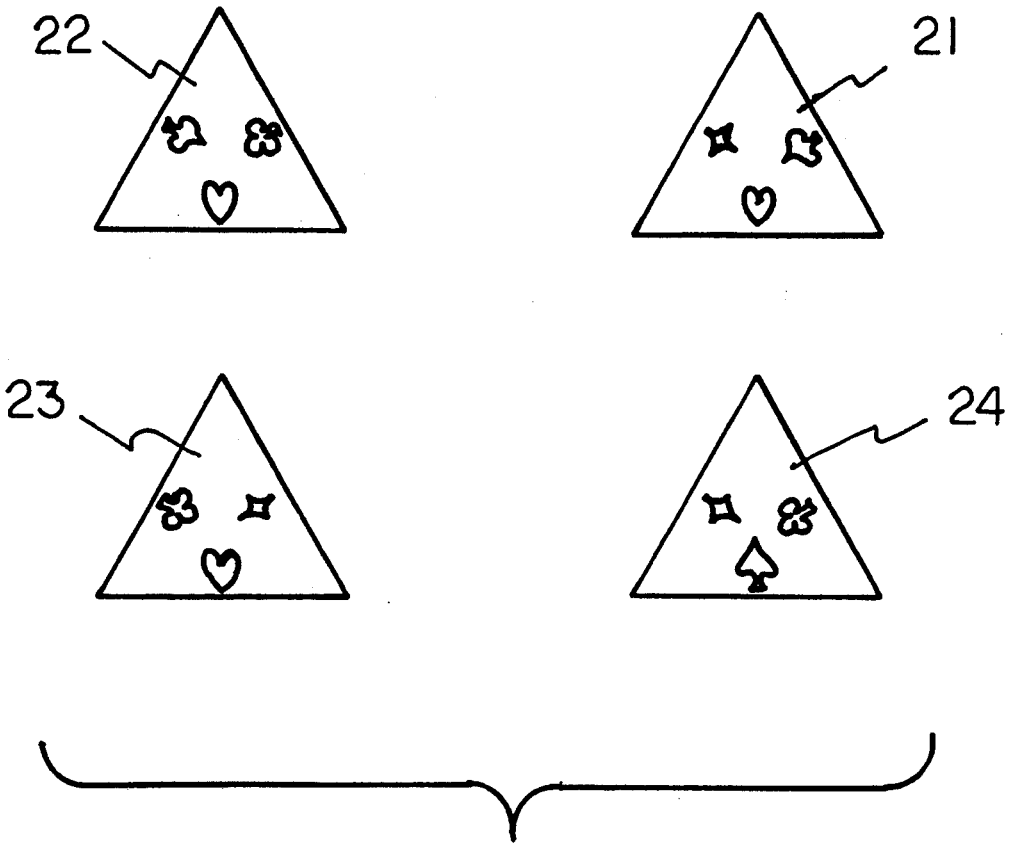
FIG. 3 is an exploded view illustrating each of the four sides of the special die.

As indicated above, when the number of cards dealt each player reaches seven, special rules apply to the next four hands. The first of these four special hands is designated "BLIND", as indicated at 40 in FIG. 4. In this end the next three hands, recourse is had to a special die to determine trump. Such die is shown in FIGS. 2 and 3, and consists of a four sided pyramid 20 having the symbol for hearts, clubs, spades, and diamonds on faces 21, 22, 23, 24 thereof. The die is rolled by the dealer to determine trumps. This procedure is common to all four of these special hands but the timing of the roll will vary. In the case of the first or "BLIND" hand, the roll is made and the players' estimate of tricks to be taken is done before any player looks at his or her cards. Estimates are recorded and then the players pick up the cards and play commences as described above.

The second special hand is designated as "HALF BLIND", as indicated at 42 in FIG. 4. In this hand, each player looks at the cards dealt and gives the estimate of tricks to be taken before the die is rolled to determine trumps. Play then proceeds in a normal fashion.

The third of the special hands is designated "MISS", as indicated at 44 in FIG. 4. Here the die is rolled after the deal to determine trumps but no estimates are given. In the play of this hand, the goal is for each player to take as few tricks as possible. When scoring the hand, five points are deducted from the player's score for each trick taken.

The fourth and last of the special hands is designated as "OFF THE TOP", as indicated at 46 in FIG. 4. Here the die is first rolled to determine trumps; the player without looking at the cards places them face down in a pile in front of him or her and makes his or her estimate; the first player then turns over and plays whichever card is on top of the pile; and succeeding players do likewise. The initial player determines the suit and the hand will be claimed in the normal fashion. The rest of the tricks are played in the normal fashion.

Finally regular play is resumed with the dealing of six cards and reducing the number each time until the final hand where only one card is dealt each player, as indicated at 48, 50, 52, and 54 in FIG. 4. Highest total score determines the winner, as indicated at 56 in FIG. 4.

As to the manner of usage and operation of the present invention, the same should be apparent from the above description. Accordingly, no further discussion relating to the manner of usage and operation will be provided.

Therefore, the foregoing is considered as illustrative only of the principles of the invention. Further, since numerous modifications and changes will readily occur to those skilled in the art, it is not desired to limit the invention to the exact method and operation shown and described, and accordingly, all suitable modifications and equivalents may be resorted to, falling within the scope of the invention.

What is claimed as being new and desired to be protected by LETTERS PATENT of the United States is as follows:

1. A method for playing a new and improved type card game for two to four players whereby ranked cards are played by each player and a number of tricks are obtained by the player playing the highest ranked card and a series of cards ranking highest over the other cards are designated as "trump" said method comprising the steps of:

a) providing a standard fifty-two card deck of playing cards containing thirteen cards each in four suits designated spades, hearts, diamonds and clubs;

a scoring sheet having hand-designating indicia thereon; and, a four sided pyramid die having on four faces thereof indicia designating one of Said four suits;

whereby said hand-designating indicia designates the trump suit and specifies a series of nineteen hands to be played when the number of players is less than four or a series of seventeen hands to be played when the number of players equals four; wherein four hands in each of said series are designated as "special" and the balance are designated as "regular";

b) starting the game by playing the series of hands specified by the hand-designating indicia;

c) playing a hand in the series comprising the steps of;

1. declaring it a "regular" further comprising the steps of;
2. dealing a total number of cards wherein fifteen cards are dealt to each player for the first hand in a series when the number of players is less than four or thirteen cards to each player for the first hand in a series When the number of players equals four;
3. each player examining the cards dealt;
4. noting the trump wherein the trump is designated by said hand-designating indicia on said score card;
5. commencing play of the hand by each player sequentially announcing each such player's estimate number of tricks to be obtained commencing with the player to the dealer's left;
6. recording said estimate number of tricks on said score sheet;
7. playing a card by the player to the dealers left placing a first card faceup, each subsequent player placing a card of the same suit as the first card if possible;
8. determining Which player played the highest ranked card and awarding that player a trick;
9. continuing play until each player has played all of his dealt cards for that hand;
10. recording a score on the score sheet one point for each trick awarded and ten points when the number of tricks awarded equals a player's estimate number of tricks;

d) repeating step c) Wherein the total number of cards dealt to each player in the stop of dealing is one less than the previous hand until the number of cards dealt equals seven, e) declaring the next "four hands to be "special" hands;

f) playing the "special" hands comprising the steps of;

designating the first "special" as "BLIND";

dealing seven cards;

rolling said die by the dealer and declaring the symbol on the top face of said die trump when it comes to rest;

commencing play of the hand by repeating the steps 5, 3 and 6–10 of c) respectively;

designating the second "special" as "HALF-BLIND";

dealings seven cards to each player;

each player examining the cards dealt;

announcing and recording each such players' estimate number of tricks to be obtained commencing with the player to the dealers left;

rolling said die by the dealer and declaring the symbol on the top face of said die trump when it comes to rest;

commencing play of the hand by repeating steps 6–10 of c) respectively;

designating the third "special" as "MISS";

dealing seven cards to each player;

each player examining the cards dealt;

rolling said die by the dealer and declaring the symbol on the top face of said die trump when it comes to rest;

commencing play of the hand by repeating steps 6–9 of c) respectively;

recording a score on the score sheet of minus five points for each trick awarded;

designating the forth "special" as "OFF THE TOP";

rolling said die by the dealer and declaring the symbol on the top face of said die trump when it comes to rest;

dealing seven cards to each player;

concealing cards for each player in a stacked pile so that they cannot be examiner by the players;

announcing the number of tricks to be taken;

commencing play of the hand by repeating step 5 of c) wherein the step 7 of playing a card requires a player to play the top card from that player's pile;

g) repeating step c) Wherein the total number of cards dealt is one less than the previous until the total number of cards dealt to each player is one;

h) totaling the scores recorded for each player and declaring the player with the highest score "the winner".

* * * * *